US009554604B2

(12) United States Patent
Rippert et al.

(10) Patent No.: US 9,554,604 B2
(45) Date of Patent: Jan. 31, 2017

(54) BACK INTEGRAL AIR DISTRIBUTION SYSTEM IN VENTILATED SUIT

(71) Applicant: HONEYWELL INTERNATIONAL INC., Morristown, NJ (US)

(72) Inventors: Cecile Rippert, Gard (FR); Swan Tuffery, Bouillargues (FR); Christophe Chessari, Gard (FR); Audrey Giboulet, Manduel (FR)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 14/680,221

(22) Filed: Apr. 7, 2015

(65) Prior Publication Data

US 2015/0282543 A1 Oct. 8, 2015

(30) Foreign Application Priority Data

Apr. 7, 2014 (EP) ..... 14163775

(51) Int. Cl.
*A62B 17/00* (2006.01)
*A41D 27/28* (2006.01)
(Continued)

(52) U.S. Cl.
CPC ..... *A41D 27/28* (2013.01); *A41D 13/0025* (2013.01); *A62B 17/005* (2013.01); *A41D 2400/20* (2013.01)

(58) Field of Classification Search
CPC ..... A62B 17/006; A62B 17/005; A62B 17/00; A62B 17/04; A62B 7/06; A62B 7/12; A62B 9/02; A62B 18/006; A62B 18/04; A62B 7/02; A41D 13/002; A41D 13/0025; A41D 13/0053; A41D 2600/102; A41D 27/28; A41D 13/00; A41D 13/0002;A41D 13/005; A41D 13/02; A41D 13/12; A41D 1/04; A41D 2200/20; A41D 2400/10; A41D 2400/20; A41D 2400/60; A41D 2400/62; B64G 6/00

See application file for complete search history.

(56) References Cited

U.S. PATENT DOCUMENTS 2,991,000 A 7/1961 Spees
3,635,216 A * 1/1972 Curtis ..... B64G 6/00 128/202.11

(Continued)

FOREIGN PATENT DOCUMENTS

DE 10315607 A1 12/2004
EP 0056613 A2 7/1982

(Continued)

OTHER PUBLICATIONS

RESPIREX International Ltd.; Airprotex FM; Product Data Sheet; Feb. 15, 2011; pp. 1-5.

(Continued)

*Primary Examiner* — Bobby Muromoto, Jr.
(74) *Attorney, Agent, or Firm* — Conley Rose, P.C.; Kristin Jordan Harkins

(57) ABSTRACT

Ventilated suit embodiments are disclosed. The ventilated suit typically comprises a hood portion, four limb portions, an air inlet port, and an air distribution system in fluid communication with the air inlet port and attached to the back portion of the ventilated suit. The air distribution systems comprises at least five air pathways that extend into the four limbs and hood of the suit, with the air pathways being in fluid communication with the air inlet port to distribute air outward into the limbs and hood.

20 Claims, 3 Drawing Sheets

(51) Int. Cl.
*A41D 13/002* (2006.01)
*A41D 13/00* (2006.01)

(56) References Cited

U.S. PATENT DOCUMENTS 3,667,459 A * 6/1972 Durney ..... A62B 18/04 128/201.15
3,802,594 A 4/1974 Lemelson
3,921,224 A * 11/1975 Ingram, III ..... A41D 13/02 2/93
3,946,896 A 3/1976 Lemelson
4,059,852 A * 11/1977 Crane ..... A41D 13/018 2/456
4,271,833 A 6/1981 Moretti
4,310,926 A * 1/1982 Maroist ..... A62B 17/005 2/81
4,460,392 A 7/1984 Poulsen et al.
4,864,654 A 9/1989 Schriver et al.
4,901,370 A 2/1990 Suda
5,062,424 A * 11/1991 Hooker ..... A41D 13/0053 128/897
5,088,115 A 2/1992 Napolitano
5,201,309 A 4/1993 Friberg et al.
5,413,567 A 5/1995 Barth et al.
5,660,169 A 8/1997 Kallstrand et al.
5,991,921 A 11/1999 Saito
6,076,571 A 6/2000 Burns
6,290,642 B1 9/2001 Reinhard et al.
6,349,721 B1 2/2002 Grilliot et al.
6,681,589 B2 * 1/2004 Brudnicki ..... A62B 7/06 128/201.28
6,758,212 B2 7/2004 Swann
6,804,836 B2 10/2004 Grilliot et al.
7,631,364 B2 12/2009 Culler et al.
8,074,299 B2 12/2011 Brookman
8,464,366 B2 6/2013 Carron
8,476,604 B2 7/2013 Yoder et al.
9,000,913 B2 * 4/2015 Patil ..... A62B 17/00 128/202.22
9,186,528 B2 * 11/2015 Patil ..... A62B 17/006
2003/0045918 A1 * 3/2003 Turner ..... A61F 7/02 607/107
2003/0140399 A1 * 7/2003 Golde ..... A41D 27/28 2/410
2003/0150232 A1 * 8/2003 Brudnicki ..... A62B 7/06 62/259.3
2003/0192103 A1 10/2003 Avery et al.
2004/0138601 A1 7/2004 Chalmers
2004/0216736 A1 * 11/2004 Lee ..... A62B 17/04 128/201.22
2004/0226558 A1 11/2004 Kausch
2004/0237178 A1 * 12/2004 Landeros ..... A62B 17/00 2/457
2005/0010996 A1 * 1/2005 Steinert ..... A62B 17/006 2/458
2005/0011517 A1 * 1/2005 Steinert ..... A62B 17/006 128/202.19
2005/0015866 A1 * 1/2005 Steinert ..... A62B 17/006 2/457
2006/0048777 A1 * 3/2006 Brookman ..... A62B 7/02 128/201.22
2006/0070162 A1 * 4/2006 Frank ..... A41D 13/0025 2/69
2007/0006607 A1 * 1/2007 Hunt ..... B64D 13/06 62/402
2007/0095088 A1 * 5/2007 Drobot Isherwood ..... A41D 13/002 62/259.3
2007/0215148 A1 * 9/2007 Tuffery ..... A41D 13/00 128/202.22
2007/0289050 A1 * 12/2007 Nocente ..... A41D 13/00 2/458
2008/0196140 A1 * 8/2008 Mayerson ..... A41D 1/04 2/84
2009/0235439 A1 9/2009 Cox et al.
2010/0037891 A1 * 2/2010 Walker ..... A62B 17/04 128/201.23
2012/0036622 A1 * 2/2012 Carron ..... A62B 9/02 2/457
2012/0066819 A1 * 3/2012 Carron ..... A62B 17/04 2/456
2012/0246809 A1 * 10/2012 Elam ..... A42B 3/048 2/424
2013/0097769 A1 * 4/2013 Tuffery ..... A62B 17/006 2/456
2013/0112211 A1 5/2013 Power et al.
2013/0269090 A1 * 10/2013 Liu ..... A62B 17/00 2/456
2013/0276217 A1 * 10/2013 Patil ..... A62B 17/006 2/456
2014/0184407 A1 * 7/2014 Patil ..... A62B 17/00 340/539.11
2015/0033437 A1 * 2/2015 Hampton ..... A41D 13/0053 2/69
2015/0250234 A1 * 9/2015 Tuffery ..... A41D 13/002 2/456

FOREIGN PATENT DOCUMENTS

FR 2899488 A1 10/2007
FR 2941624 A1 8/2010
GB 2401553 B 8/2005
WO 2006012475 A2 2/2006

OTHER PUBLICATIONS

PPS Professional Protection Systems; PPS Product Data Sheet; Nuclear Powered Respirator Suit (NuPo Suit); Paper No. L0041-080711; pp. 1-2.
EP12188062, European Search Report, dated Jan. 27, 2014, 2 pages.
EP14163775, Partial European Search Report,dated Aug. 7, 2014, 4 pages.
EP14163775, European Search Report,dated Oct. 16, 2014, 6 pages.

* cited by examiner

BACK INTEGRAL AIR DISTRIBUTION SYSTEM IN VENTILATED SUIT

CROSS-REFERENCE TO RELATED APPLICATIONS

This application is related to and claims priority to Europe Patent Application No. EP14163775.1 entitled "Back Integral Air Distribution in Ventilated Suit" and filed on Apr. 7, 2014, which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPEND

Not applicable.

FIELD OF THE INVENTION

Disclosed embodiments relate generally to the design of ventilated suits comprising air distribution systems.

BACKGROUND

Personal protection equipment (PPE) suits may comprise ventilated suits formed of air impenetrable fabric and/or plastic. These suits may comprise air distribution systems operable to direct air flow between the limps and hood of the ventilated suits. The air distribution systems may distribute air from a power air supply or port that is connected to the suit. The air distribution systems may also relieve pressure built up in the limb portions of the suit when a user moves, bends, sits, or kneels, and may redirect breathing air through the suit to avoid a build-up of carbon dioxide in the hood portion of the suit.

SUMMARY

Aspects of the disclosure may include embodiments of a ventilated suit comprising: a hood portion; four limb portions; an air inlet port; and an air distribution system in fluid communication with the air inlet port and attached to the back portion of the ventilated suit, the air distribution system comprising: at least five air pathways extending into the four limbs and hood of the suit, the air pathways in fluid communication with the air inlet port; and attachment points between the air pathways and the fabric of the back of the suit. In some embodiments, the ventilated suit is formed of one of: an air impenetrable fabric, an air impenetrable plastic, or a breathable fabric. In some embodiments, the air pathways comprise layers of fabric and the attachment points comprise stitches between the fabric of the air pathways and the fabric of the suit. In some embodiments, the fabric of the air pathways is similar to the fabric of the suit. In some embodiments, the fabric of the suit comprises one of the layers that form the air pathways. In some embodiments, the air pathways comprise hoses and the attachment points comprise loops stitched into the fabric of the suit. In some embodiments, the air distribution system further comprises an air let pouch, fluidly connected to the air inlet port and the at least five hoses. In some embodiments, the hoses comprise a flexible plastic material. In some embodiments, the air distribution system comprises a central portion in fluid communication with the air inlet port and a all of the at least five air pathways.

Other aspects of the disclosure include a ventilated suit comprising: a hood portion; four limb portions, comprising arm portions and leg portions; an air inlet port; and an air distribution system in fluid communication with the air inlet port and attached to the back portion of the ventilated suit, the air distribution system comprising: at least five air pathways extending into the four limbs and hood of the suit, the air pathways in fluid communication with the air inlet port, wherein: the ventilated suit is formed or an air impenetrable fabric; the at least five air pathways are comprised layers of fabric; and the air pathways are formed by stitches between the layers of fabric of the suit. In some embodiments, the fabric of the suit comprises one of the layers that form the air pathways. In some embodiments, the fabric of the air pathways is similar to the fabric of the suit. In some embodiments, the at least five air pathways comprise a first pathway extending into the hood portion of the suit, a second pathway extending into an arm portion of the suit, a third pathway extending into an arm portion of the suit, a fourth pathway extending into a leg portion of the suit, and a fifth pathway extending into a leg portion of the suit. In some embodiments, the first pathway comprises two sections that extend around either side of the hood portion of the suit. In some embodiments, the stitches form ports at the end of each of the air pathways, and the ports allow air to flow into and out of the air pathways.

Additional aspects of the disclosure may include a ventilated suit comprising: a hood portion; four limb portions, comprising arm portions and leg portions; an air inlet port; and an air distribution system in fluid communication with the air inlet port and attached to the back portion of the ventilated suit, the air distribution system comprising: at least five air pathways extending into the four limbs and hood of the suit, the air pathways in fluid communication with the air inlet port; and attachment points between the air pathways and the fabric of the back of the suit, wherein: the ventilated suit is formed or an air impenetrable fabric; and the air pathways comprise hoses. In some embodiments, the attachment points comprise loops sewn into the fabric of the suit. In some embodiments, the at least five air pathways comprise a first pathway extending into the hood portion of the suit, a second pathway extending into an arm portion of the suit, a third pathway extending into an arm portion of the suit, a fourth pathway extending into a leg portion of the suit, and a fifth pathway extending into a leg portion of the suit. In some embodiments, the air distribution system comprises a central air inlet pouch in fluid communication with the air inlet port and all of the at least five air pathways. In some embodiments, writ comprises a disposable suit operable to be worn once by a user.

BRIEF DESCRIPTION OF THE DRAWINGS

For a more complete understanding of the present disclosure, and for further details and optional advantages thereof, reference is now made to the accompanying drawings, wherein.

DETAILED DESCRIPTION OF THE INVENTION

The following brief definition of terms shall apply throughout the application:

The term "comprising" means including but not limited to, and should be interpreted in the manner it is typically used in the patent context;

The phrases "in one embodiment." "according to one embodiment," and the like generally mean that the particular feature, structure, or characteristic following the phrase is included in at least one embodiment of the present invention, and may be included in more than one embodiment of the present invention (importantly, such phrases do not necessarily refer to the same embodiment); and If the specification states a component or feature "may," "can," "could," "should" or "might" be included or has a characteristic, that particular component or feature is not required to be included or to have the characteristic.

Embodiments relate generally to the design of ventilated suits comprising air distribution systems. Embodiments include air distribution systems that extend into the four limbs of the suit as well as the hood portion of the suit, wherein the air distribution system is attached to the back side of the suit. Applicants have found that attaching the air pathways of an air distribution system to the back of the suit, as opposed to the front of the suit, may reduce the likelihood of a user's movements compromising the integrity of the air distribution system. In other words, an air distribution system attached to the back side of the suit may be less likely to be damaged or obstructed when a user kneels, bends, or sits while wearing the suit.

Figure 1:
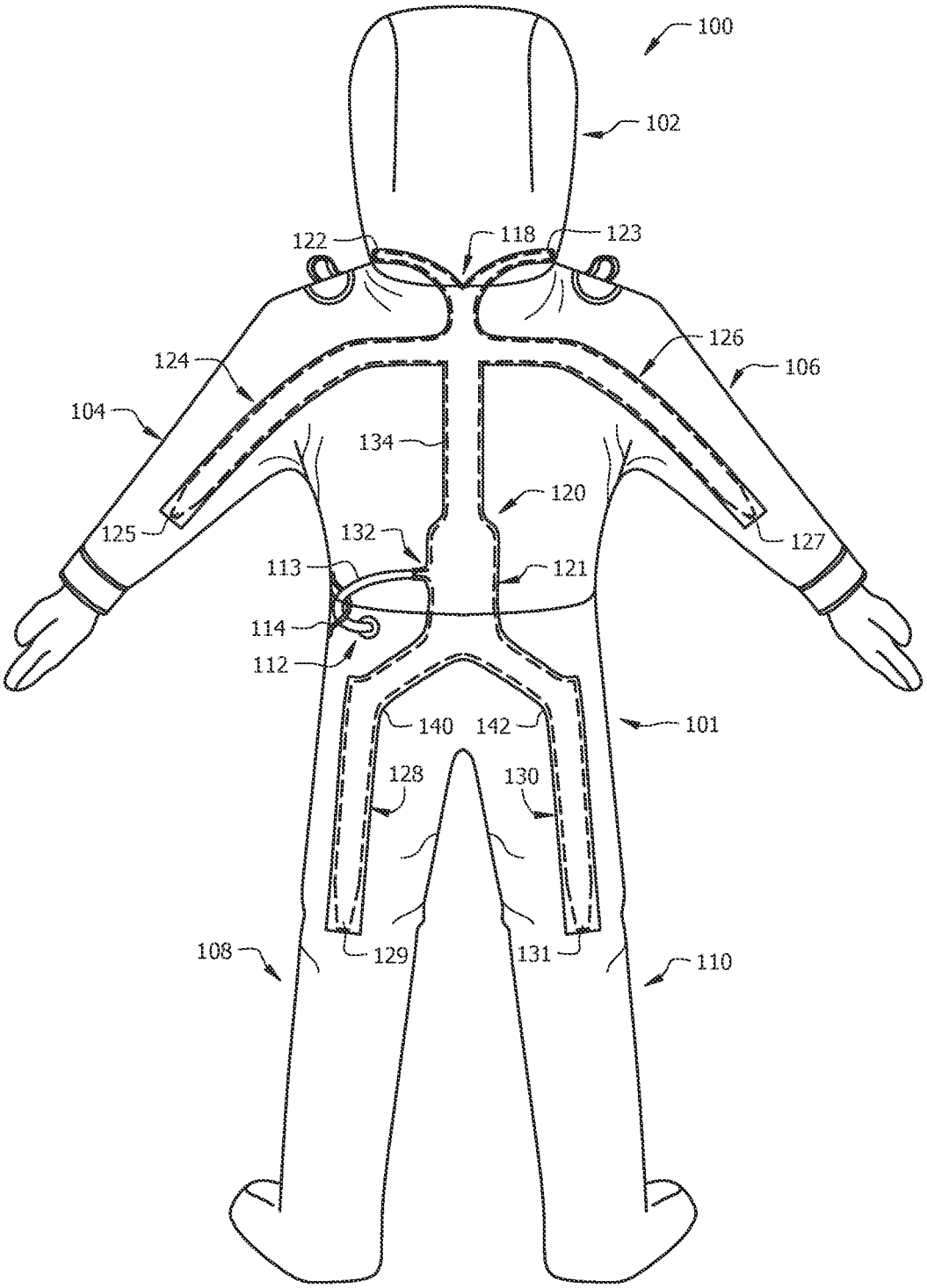
FIG. 1 illustrates an embodiment of a ventilated suit comprising an air distribution system.

FIG. 1 illustrates a ventilated suit 100 comprising an air distribution system 120. The ventilated suit 100 may comprise a hood portion 102, a first limb portion 104, which may be an arm portion, a second limb portion 106, which may be an arm portion, a third limb portion 108, which may be a leg portion, and a fourth limb portion 110, which may be a leg portion. The ventilated suit 100 may also comprise and air inlet port 112 in fluid communication with the air distribution system 120. In some embodiments, the ventilated suit 100 may comprise an air impenetrable fabric or plastic material. In other embodiments, the suit 100 may comprise a breathable material, such as a nonwoven fabric. The ventilated suit 100 may be considered a protective suit, even if the material is breathable, because of the overpressure inside of the suit 100. In some embodiments, the suit 100 may comprise a disposable suit which may be worn once by a user. In other embodiments, the suit 100 may comprise a reusable suit which may be worn multiple times by a user.

In the embodiment shown, the air distribution system 120 may comprise at least five air pathways 118, 124, 126, 128, and 130 that extend into the four limb portions 104, 106, 108, 110 of the suit 100 as well as the hood portion 102 of the suit. In the embodiment shown, the air distribution system 120 may comprise a first pathway 118 that extends into the hood portion 102 of the suit 100, a second pathway 124 that extends into an arm portion 104 of the suit 100, a third pathway 126 that extends into an arm portions 106 of the suit 100, a fourth pathway 128 that extends into a leg portion 108 of the suit 100, and a fifth pathway 130 that extends into a leg portion 110 of the suit 100. In some embodiments, the fourth pathway 128 and fifth pathway 130 may comprise bends 140 and 142 that allow the pathways 128 and 130 to extend to the sides of the leg portions 108 and 110 of the suit 100. This may allow a user to kneel and/or sit while Tearing the sprit 100 without closing off, obstructing, or damaging the air pathways 128 and 130.

In some embodiments, the air distribution system 120 may comprise a central portion 121 that is in fluid communication with the air inlet port 112 of the suit 100. The central portion 121 may fluidly connect all of the pathways 118, 124, 126, 128 and 130. The central portion 121 may connect to a hose 113 at a connection point 132, wherein the hose 113 may connect to the air inlet port 112, in some embodiments, the hose 113 may be held in place by a strap 114.

In some embodiments, the air distribution system 120 may comprise an attachment or attachment points between the material of the suit 100 and the material of the air distribution system 120. In the embodiment shown in FIG. 1, the attachment may comprise stitching 134 (or sewing) along the edges of the air distribution system 120. In some embodiments, the stitching 134 may create ports at the end of each of the pathways, wherein the ports allow air to flow into and out of the pathways. For example, the first pathway 118 may comprise two separate ports 122 and 123 that extend to either side of the hood portion 102. The second pathway 124 may comprise a port 125, the third pathway 126 may comprise a port 127, the fourth pathway 128 may comprise a port 129, and the fifth pathway 130 may comprise a port 131. The stitching 134 may hold the air distribution system 120 in place within the suit 100 while it s being worn by a user. In other embodiments, the air pathways 118, 124, 126, 128, and 130 may be attached or affixed to the back side 101 of the suit 100 via taping, fixing, gluing, and/or welding (such as ultrasonic, thermic, or radiofrequency welding).

Figure 2:
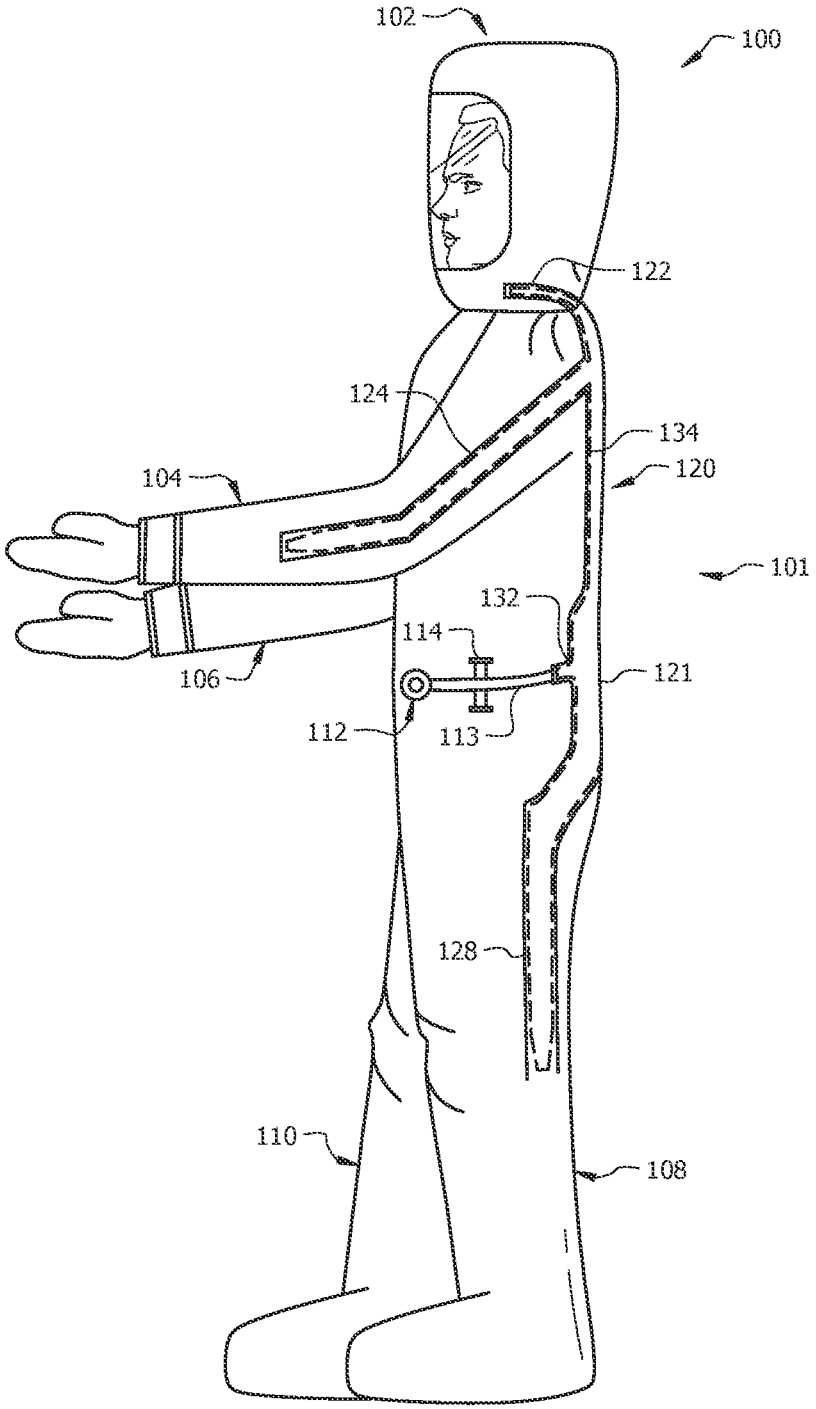
FIG. 2 illustrates a side view of the embodiment shown in FIG. 1.

In the embodiment shown, the air distribution system 120 may be connected to the back side 101 of the suit 100, such that when the suit 100 is worn by a user, the air distribution system 120 may be located at their back. FIG. 2 illustrates a side view of the suit 100, where it can be seen that the air distribution system is connected to the back side 101 of the suit 100. In some embodiments, the air pathways 118, 124, 126, 128, and 130 of the air distribution system 120 may comprise layers of material or fabric sewn together to form a pathway, wherein the material of the pathways may, in some embodiments, be similar to the material of the suit 100. In some embodiments, the air pathways 118, 124, 126, 128, and 130 may comprise one layer of fabric sewn to the fabric of the suit 100 to form the pathway.

Figure 3:
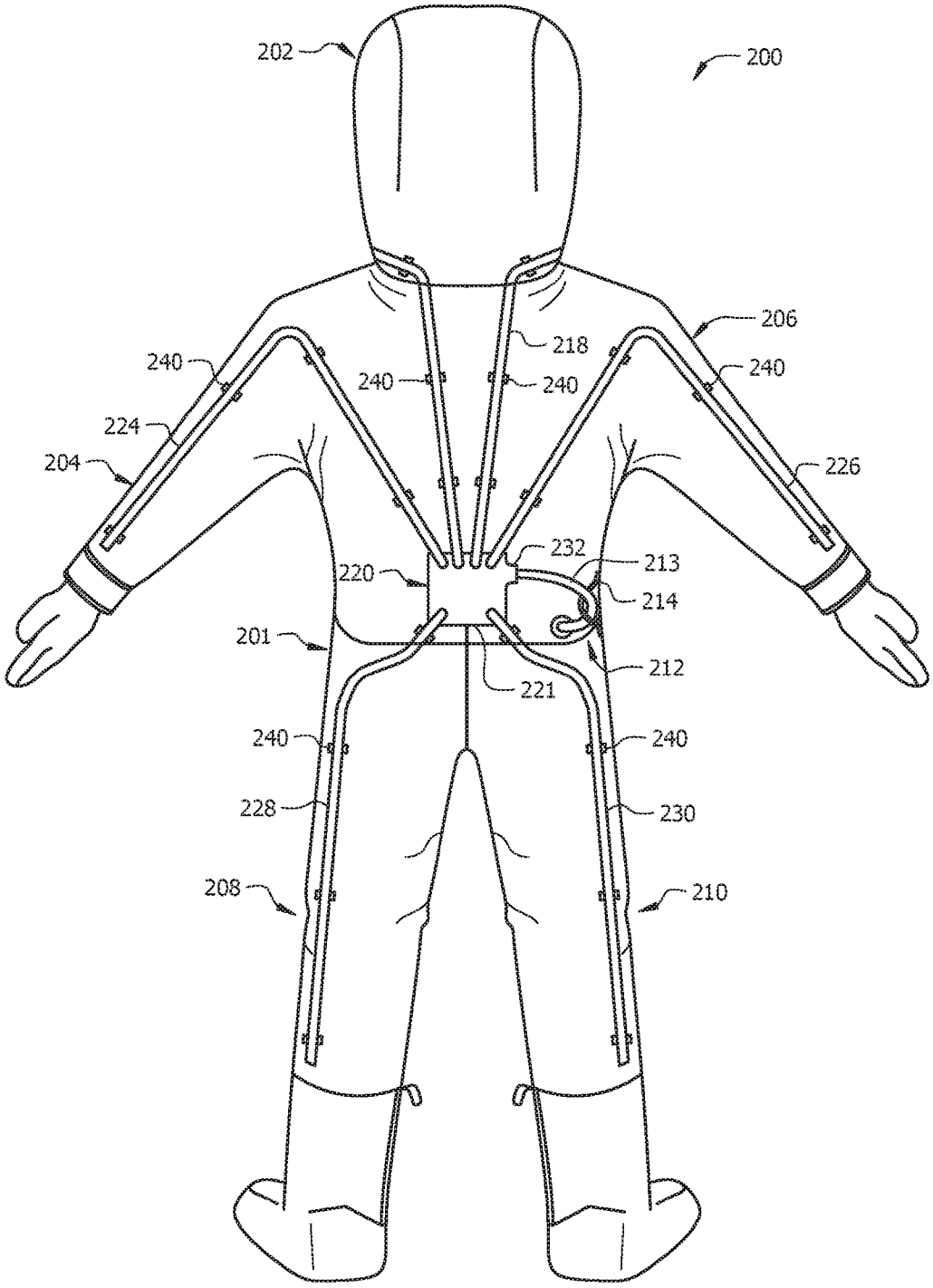
FIG. 3 illustrates another embodiment of a ventilated suit comprising an air distribution system.

FIG. 3 illustrates another embodiment of a ventilated suit 200 comprising an air distribution system 220. The ventilated suit 200 may comprise a hood portion 202, a first limb portion 204, which may be an arm portion, a second limb portion 206, which may be an arm portion, a third limb portion 208, which may be a leg portion, and a fourth limb portion 210, which may be a leg portion. The ventilated suit 200 may also comprise and air inlet port 212 in fluid communication with the air distribution system 220. In some embodiments, the ventilated suit 200 may comprise an air impenetrable fabric or plastic material. In other embodiments, the suit 100 may comprise a breathable material, such as a nonwoven fabric. The ventilated suit 100 may be considered a protective suit, even if the material is breathable, because of the overpressure inside of the suit 100. In some embodiments, the suit 200 may comprise a disposable suit which may be worn once by a user. In other embodiments, the suit 200 may comprise a reusable suit which may be worn multiple times by a user.

In the embodiment shown, the air distribution system 220 may comprise at least five air pathways 218, 224, 226, 228, and 230 that extend into the four limb portions 204, 206, 208, 210 of the suit 200 as well as the hood portion 202 of the suit. In the embodiment shown, the air distribution system 220 may comprise a first pathway 218 that extends into the hood portion 202 of the suit 200, a second pathway 224 that extends into an arm portion 204 of the suit 200, a third pathway 226 that extends into an arm portions 206 of the suit 200, a fourth pathway 228 that extends into a leg portion 208 of the suit 200, and a fifth pathway 230 that extends into a leg portion 210 of the suit 200. In some embodiments, the fourth pathway 228 and fifth pathway 230 may extend to the sides of the leg portions 208 and 210 of the suit 200. This may allow a user to kneel and/or sit while wearing the suit 200 without closing off, obstructing, or damaging the air pathways 228 and 230.

hr some embodiments, the air distribution system 220 may comprise a central portion 221 that is in fluid communication with the air inlet port 212 of the suit 200. The central portion 221 may fluidly connect all of the pathways 218, 224, 226, 228 and 230. The central portion 221 may connect to a hose 213 at a connection point 232 wherein the hose 213 may connect to the air inlet port 212. In some embodiments, the hose 213 may be held in place by a strap 214.

In some embodiments, the air distribution system 220 may comprise an attachment or attachment points between the material of the suit 200 and the material of the air distribution system 220. In the embodiment shown in FIG. 3, the attachment may comprise loops 240 spread along the length of the air pathways of the air distribution system 220, wherein the loops may be attached to the fabric of the suit 200. The loops 240 may hold the air distribution system 220 in place within the suit 200 while it is being worn by a user. In other embodiments, the air pathways 218, 224, 226, 228, and 230 may be attached or affixed to the back side 201 of the suit 200 via sewing, taping, fixing, gluing, and/or welling (such as ultrasonic, thermic, or radiofrequency welding).

In the embodiment shown, the air distribution system 220 may be connected to the back side 201 of the suit 200, such that when the suit 200 is worn by a user, the air distribution system 220 may be located at their back. In some embodiments, the air pathways 218, 224, 226, 228, and 230 of the air distribution system 220 may comprise hoses. In some embodiments, the hoses may be formed of a flexible plastic material. In some embodiments, the central portion 221 of the air distribution system 220 may comprise an air inlet pouch fluidly connected to the air inlet port 212 and the hoses 218, 224, 226, 228, and 230.

The figures discussed above provide examples of various exemplary devices, systems, and techniques and ways to make and use such devices. These illustrations are merely exemplary. The scope of the present disclosure extends beyond the specific examples set forth above, capturing the full range of the inventive concept (and including all equivalents).

While various embodiments in accordance with the principles disclosed herein have been shown and described above, modifications thereof may be made by one skilled in the art without departing from the spirit and the teachings of the disclosure. Alternative embodiments that result from combining, integrating, and/or omitting features of the disclosed embodiments are also within the scope of this disclosure. The embodiments described herein are representative only and are not intended to be limiting. Many variations, combinations, and modifications are possible and are within the scope of the disclosure. Accordingly, the scope of protection is not limited by the description set out above, but is defined by the claims Which follow, that scope including all equivalents of the subject matter of the claims. Furthermore, any advantages and features described above may relate to specific embodiments but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall lot limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention (s), and their equivalents, that are protected thereby. The term "comprising" as used herein is to be construed broadly to mean including but not limited to, and in accordance with its typical usage in the patent context, is indicative of inclusion rather than limitation (such that other elements may also be present). In all instances, the scope of the claims shall be considered on their own merits in light of this disclosure, but should not be constrained by the headings set forth herein.

What is claimed is:

1. A ventilated suit comprising:
a hood portion;
four limb portions;
an air inlet port; and
an air distribution system in fluid communication with the air inlet port and the air distribution system attached to the back portion of the ventilated suit, the air distribution system comprising:
at least five air pathways extending into the four limbs and hood of the suit, each of the air pathways in fluid communication with the air inlet port and configured to distribute air from the air inlet port out into corresponding one of the four limbs and hood of the suit; and
attachment points between the air pathways and the fabric of the back of the suit.

2. The suit of claim 1, wherein the air distribution system comprises a central portion in fluid communication with the air inlet port and all of the at least five air pathways, configured such that air from the air inlet port flows into the central portion and then into the at least five air pathways.

3. The suit of claim 1, wherein the ventilated suit is formed of one of an air impenetrable fabric, an air impenetrable plastic, or a breathable fabric.

4. The suit of claim 3, wherein the air pathways comprise layers of fabric and the attachment points comprise stitches between the fabric of the air pathways and the fabric of the suit.

5. The suit of claim 4, wherein at least one layer of the fabric of the air pathways and the fabric of the suit comprise being at least one of an air impenetrable fabric and a nonwoven fabric.

6. The suit of claim 4, wherein the fabric of the suit comprises one of the layers that form the air pathways.

7. The suit of claim 3 wherein the air distribution system comprise hoses and the attachment points comprise loops stitched into the fabric of the suit.

8. The suit of claim 7, wherein the air distribution system further comprises an air inlet pouch, fluidly connected to the air inlet port and the at least five hoses.

9. The suit of claim 7, wherein the hoses comprise a flexible plastic material.

10. A ventilated suit comprising:

a hood portion;

four limb portions, comprising arm portions and leg portions;

an air inlet port; and an air distribution system in fluid communication with the air inlet port and the air distribution system attached to the back portion of the ventilated suit, the air distribution system comprising:

at least five air pathways formed between layers of fabric extending into the four limbs and hood of the suit, each of the air pathways in fluid communication with the air inlet port and configured to distribute air from the air inlet port out into corresponding one of the four limbs and hood of the suit, wherein:

the ventilated suit is formed of an air impenetrable fabric;

the at least five air pathways comprise the layers of fabric; and the air pathways are formed by stitches between the at least a layer of fabric and the fabric of the suit.

11. The suit of claim 10, wherein the fabric of the suit comprises one of the layers that form the air pathways.

12. The suit of claim 10, wherein at least one layer of the fabric of the air pathways and the fabric of the suit comprise being at least one of an air impenetrable fabric and a nonwoven fabric.

13. The suit of claim 10, wherein the stitches form ports at each end of each of the air pathways, and the ports allow air from the air inlet port to flow into corresponding air pathway and out of the air pathways into the suit.

14. The suit of claim 10, wherein the at least five air pathways comprise a first pathway extending into the hood portion of the suit, a second pathway extending into an arm portion of the suit, a third pathway extending into an arm portion of the suit, a fourth pathway extending into a leg portion of the suit, and a fifth pathway extending into a leg portion of the suit.

15. The suit of claim 14, wherein the first pathway comprises two sections that extend around either side of the hood portion of the suit.

16. A ventilated suit comprising:

a hood portion;

four limb portions, comprising arm portions and leg portions;

an air inlet port; and an air distribution system in fluid communication with the air inlet port and the air distribution system attached to the back portion of the ventilated suit, the air distribution system comprising:

a central portion in fluid communication with the air inlet port;

at least five air pathways formed between layers of fabric extending into the four limbs and hood of the suit, each of the air pathways in fluid communication with the air inlet port via the central portion and configured to distribute air from the air inlet port out into corresponding one of the four limbs and hood of the suit; and attachment points between the air pathways and the fabric of the back of the suit, wherein:

the ventilated suit is formed of an air impenetrable fabric; and the air pathways comprise hoses.

17. The suit of claim 16, wherein the attachment points comprise loops sewn into the fabric of the suit.

18. The suit of claim 16, wherein the at least five air pathways comprise a first pathway extending into the hood portion of the suit, a second pathway extending into an arm portion of the suit, a third pathway extending into an arm portion of the suit, a fourth pathway extending into a leg portion of the suit, and a fifth pathway extending into a leg portion of the suit.

19. The suit of claim 16, wherein the central portion comprises a central air inlet pouch in fluid communication with the air inlet port and all of the at least five air pathways.

20. The suit of claim 16, wherein the suit comprises a disposable suit operable to be worn once by a user.

* * * * *